US005799227A

United States Patent [19]

Matheis et al.

[11] Patent Number: 5,799,227

[45] Date of Patent: Aug. 25, 1998

[54] NON-MAGNETIC TONER DYNAMIC RECYCLING

[75] Inventors: Mark A. Matheis, Frederick, Md.; Daniel E. Kanfoush, Niagara Falls; Orrin D. Christy, North Tonawanda, both of N.Y.

[73] Assignee: Moore Business Forms, Inc., Grand Island, N.Y.

[21] Appl. No.: 659,612

[22] Filed: Jun. 6, 1996

[51] Int. Cl.[6] ..... G03G 15/08

[52] U.S. Cl. ..... 399/92; 399/292; 399/359; 251/5

[58] Field of Search ..... 399/91, 92, 93, 399/98, 359, 252, 253, 290, 292; 222/DIG. 1; 251/5

[56] References Cited

U.S. PATENT DOCUMENTS

| | | | |
|---|---|---|---|
| 3,195,586 | 7/1965 | Vogt | 251/5 X |
| 3,703,957 | 11/1972 | Swanson et al. | 209/31 |
| 4,724,459 | 2/1988 | Ford | 399/359 X |
| 4,972,203 | 11/1990 | Brecy et al. . | |
| 4,996,538 | 2/1991 | Brecy et al. . | |
| 5,028,959 | 7/1991 | Gooray . | |
| 5,103,264 | 4/1992 | Bhagat . | |
| 5,146,279 | 9/1992 | Seyfried . | |
| 5,260,747 | 11/1993 | Uwagawa et al. . | |
| 5,268,727 | 12/1993 | Thayer et al. . | |
| 5,376,994 | 12/1994 | Mama et al. . | |
| 5,381,217 | 1/1995 | Ishida . | |
| 5,424,806 | 6/1995 | Siegel . | |
| 5,521,690 | 5/1996 | Taffler et al. | 399/93 |
| 5,532,100 | 7/1996 | Christy et al. | 430/120 |

FOREIGN PATENT DOCUMENTS

| | | |
|---|---|---|
| 0 494 454 | 7/1992 | European Pat. Off. . |
| 56-107281 | 8/1981 | Japan . |
| 60-107681 | 6/1985 | Japan . |
| 1391835 | 4/1975 | United Kingdom . |
| WO 94/05979 | 3/1994 | WIPO . |

*Primary Examiner*—Joan H. Pendegrass

[57] ABSTRACT

Non-magnetic toner in an electrostatic imaging system, such as the MIDAX® electronic imaging system, is dynamically recycled. Wayward airborne toner particles in the imaging system are vacuum collected to provide an air stream with entrained toner particles, and a centrifugal separator separates the particles from the entraining air. The separated particles are then dynamically returned to the imaging system. At least one airlock, which may comprise at least first and second fluid actuated or mechanically actuated valves which are spaced from each other, is provided between the separator and a reservoir for toner particles to be supplied to a fluidized bed of toner particles in the imaging system. A distribution device for distributing the toner particles in at least two different horizontal paths, to return to the reservoir.

19 Claims, 10 Drawing Sheets

FIG. 4a
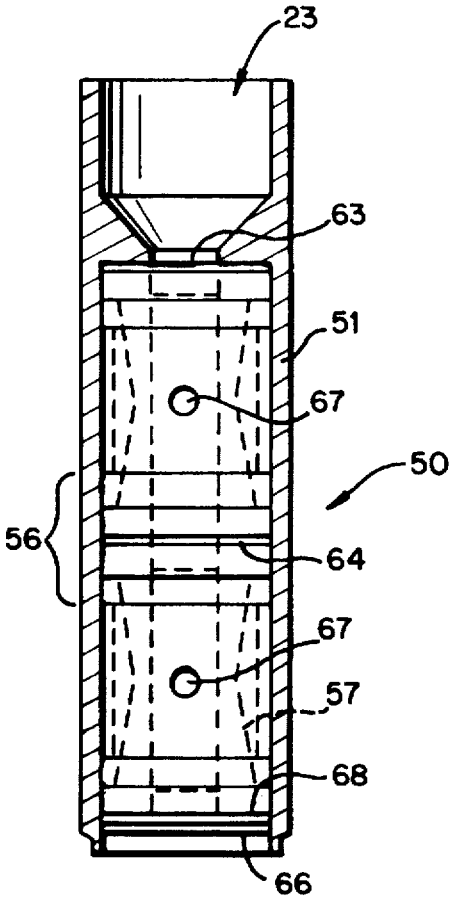
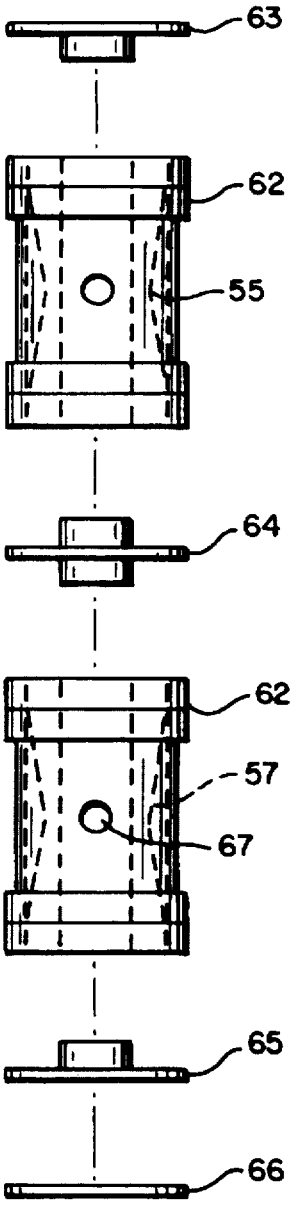
FIG. 4b
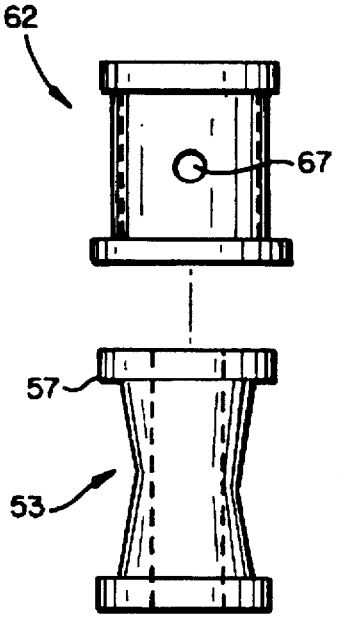
FIG. 4c

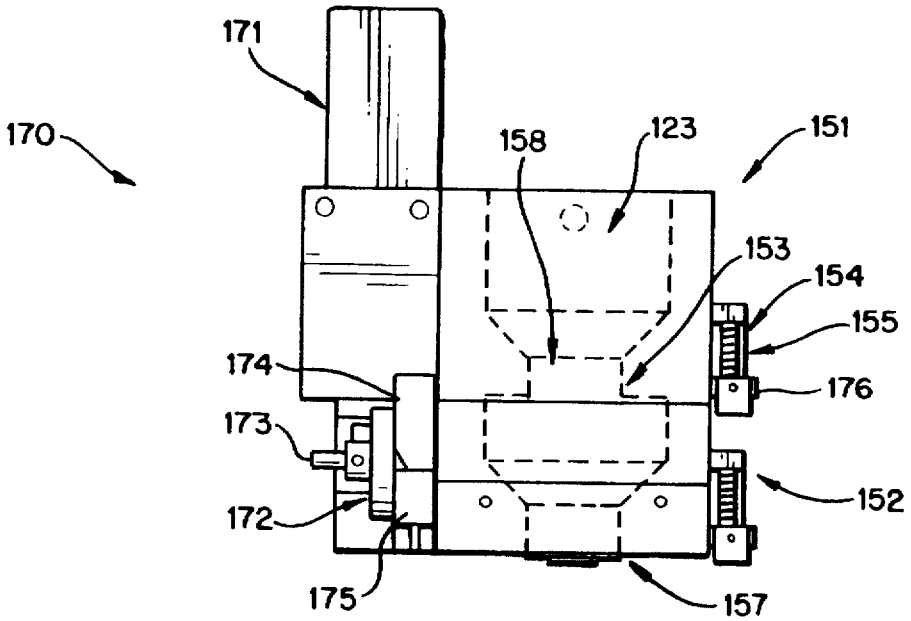
FIG. 8a
FIG. 8b
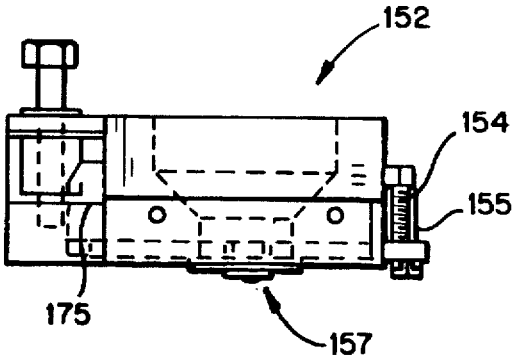
FIG. 8c
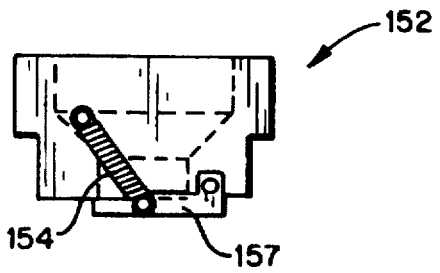
FIG. 8d
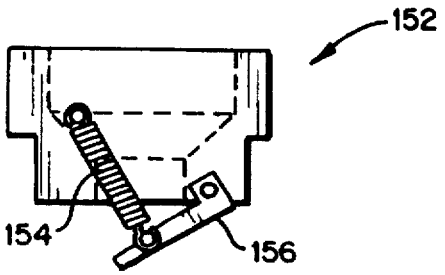

NON-MAGNETIC TONER DYNAMIC RECYCLING

BACKGROUND AND SUMMARY OF THE INVENTION

In electrostatic imaging systems, regardless of the exact imaging technique, there is the potential for a significant number of wayward toner particles. The problem can be particularly acute in non-magnetic toner electronic imaging systems such as the MIDAX® imaging system of Moore Business Forms, Inc. of Lake Forest, Illinois. The system uses a developer unit which includes a fluidized bed of non-magnetic toner particles supplied with the reservoir, and is generally shown in European published patent application 0 494 454, in which toner is transferred by developer rollers to a substrate for imaging the substrate. The toner when fluidized has a tendency to vector out of the fluid bed area, and can create dusting on the substrate which is being imaged. This dusting reduces the print quality, and therefore it is highly desirable to minimize or eliminate the wayward toner particles which cause the dusting.

In the past attempts have been made to control the dusting problem by utilizing a vacuum above the toning rollers. The vacuum removes the wayward airborne toner particles not attracted to the imaging rollers. Unfortunately, such a system results in a high rate of toner waste. If the toner particles are separated from the vacuum induced air flow and captured in a static container, there still is the problem of periodically replacing the container, and then introducing the particles from the container into a reservoir for the toner particles.

According to the present invention a method and apparatus are provided which overcome the problem of "dusting" in electrostatic imaging equipment such as described above, and do so in a cost effective and environmentally friendly manner. Utilizing the method and apparatus according to the present invention toner waste is reduced from as high as 60% in prior art procedures to less than 10%, which is an acceptable toner loss in many types of imaging equipment, such as MIDAX® non-magnetic imaging systems. A significant feature of many aspects of the present invention is that the recycling of the toner may be done dynamically (that is substantially without operator intervention) rather than statically (that is where it is necessary to manually periodically replace canisters filled with recycled toner particles, and to then manually return the recycled toner particles to the toner particle reservoir).

According to one aspect of the present invention a method of using toner in an electrostatic imaging system comprises the following steps: (a) Vacuum collecting airborne wayward toner particles in the electrostatic imaging system to provide an air stream with entrained toner particles. (b) Causing the air stream with entrained toner particles to flow in a vortex so that the toner particles are separated from the entraining air. And (c) dynamically returning the separated toner particles to the electrostatic imaging system. In this way the wayward toner particles are controlled so that the dusting problem which often exists in electrostatic imaging systems is avoided.

The invention is perhaps most advantageously applicable to electrostatic imaging systems which use a fluidized bed of non-magnetic toner particles, supplied by a reservoir of such non-magnetic toner particles (such as the MIDAX® system described above). In this case step (c) is typically practiced to dynamically return the non-magnetic toner particles to the reservoir. Step (c) is also preferably practiced by passing the toner particles through at least one airlock. The airlock may comprise first and second flexible material pinching valves, or first and second mechanical valves, and in either case step (c) is practiced by selectively actuating the valve (by selectively applied fluid under pressure, or selective mechanical actuation) so that only one valve is open at a time.

Step (c) is typically further practiced by distributing the toner in at least two different substantially horizontal paths after the toner reservoir passes through the at least one airlock and before it returns to the reservoir. Desirably step (b) is practiced vertically above the airlock, and the airlock is vertically above the reservoir so that after separation from entrained air the toner particles flow primarily by gravity to the reservoir (although they may be fluidized to facilitate their distribution after passing through the airlock). Step (b) may be practiced by using a centrifugal separator having a substantially circular inlet opening having a diameter of between about 0.75–1.5 inches, and by introducing toner particles entrained in the air into the opening at a velocity of between 500–2500 feet per minute (e.g. about 1000–2000 feet per minute).

According to another aspect of the present invention a toner recycling system is provided comprising the following components: An imaging system which applies toner to substrates. A centrifugal separator for separating toner particles from air entraining the toner particles. A vacuum system for collecting wayward airborne toner particles from the imaging system, and delivering the toner particles entrained in air to the centrifugal separator. And means for dynamically returning toner particles separated from the entrained air by the centrifugal separator, to the imaging system.

The means for dynamically returning toner particles may comprise at least one airlock between the imaging system and the separator. The imaging system desirably includes a fluidized bed of non-magnetic toner particles supplied with particles by a reservoir, and the system typically also includes a fluidizing distributing means between the airlock and the reservoir to cause particles to flow from the airlock to the reservoir. The fluidizing distributing means may comprise a porous horizontal plate located below the airlock and through which fluidizing air is passed, gently, which causes the toner particles to flow in at least two different substantially horizontal paths, to be distributed to the reservoir at the end of those paths.

The airlock may comprise any suitable conventional construction in which it is possible to form a chamber between two different spaced closure elements in the path of toner movement so that the closure elements may be alternatively opened so that the vacuum in the separator does not "leak" through the toner discharge path, thereby rendering the system inefficient or ineffective (that is, the airlock must substantially separate the low pressure (vacuum) side from the higher pressure (e.g. ambient) side at all times). In one embodiment according to the invention the airlock comprises first and second flexible material pinching valves and means for selectively applying fluid under pressure to the valves so that only one valve is open at a time. For example, a vertical tubular housing having the pinching valve assemblies stacked one above the other is provided, each pinching valve assembly comprising a flexible valve element, an open volume surrounding the flexible valve element, and an automatically controlled fluid supply means for supplying fluid to the open volume of the pinching valve assembly so that only one valve is open at a time.

Alternatively, the airlock may comprise first and second mechanical valves and means for selectively mechanically actuating the first and second valves so that only one valve is open at a time. The mechanical valves may comprise spring biased doors which are moved downwardly by a cam actuator (powered by an electrical motor and associated gearing). However, other types of valve elements are also readily utilizable to effect the desired results according to the invention. For example, ball valves, butterfly valves, gate valves, slide valves, solenoid valves, or like conventional structures, actuated in response to conditions, by fluid, electrically, sonically, mechanically, or the like, may be utilized.

In the preferred embodiment the centrifugal separator is vertically oriented having a top and a bottom, and includes a tangential inlet opening, a gas outlet from adjacent the top thereof, and a particle outlet from adjacent the bottom thereof. The airlock is located vertically below the particle outlet and the imaging system is located vertically below the airlock so that recycled toner may flow primarily by gravity from the separator to the imaging system. The vacuum system typically includes a hose extending upwardly from the imaging system to the separator inlet, and a vacuum pump connected to the separator outlet.

According to another aspect of the present invention a toner recycling system is provided comprising the following components: A vertically oriented centrifugal separator having a top and a bottom, a tangential inlet, a toner outlet adjacent the bottom, and a fluid outlet adjacent the top. An airlock assembly vertically below the toner outlet and connected thereto in substantially air-tight relationship, the airlock assembly including at least first and second valves. And a toner distributing means located beneath the airlock assembly for distributing toner from the airlock assembly into at least two different paths. The centrifugal separator opening is typically substantially circular, for example, having a diameter of between about 0.75–1.5 inches, and is connected to a vacuum hose, and the fluid outlet is connected to a vacuum pump.

While it is preferred that the means for dynamically returning the toner particles to the imaging system comprise at least one airlock and simple gravity flow, since such elements may be readily obtained and produced cost effectively, other mechanisms can also be utilized. For example, a series of check valves may be utilized which automatically open only when particles of the particular mass have collected thereon, or a tortuous path could be provided with mechanisms associated with the path that would allow the particles to form a seal (such as in a J-seal, gill-shaped seal, or the like) if the particles are fluid enough and if the tortuous path allows relatively fluid flow of the particles therein. Other conventional components and equipment may also be utilized.

When automatically operated valves are utilized, automatic operation may be in spaced periods of time (e.g. periodically), or condition responsive (that is in response to the flow rate to the separator, or the amount of particles collecting in a chamber above each valve, etc.), utilizing suitable sensors (e.g. flow rate, mass, and/or conductivity sensors).

It is the primary object of the present invention to provide for the effective and dynamic recycling of toner particles in imaging systems so as to minimize dusting from wayward toner particles. This and other objects of the invention will become clear from an inspection of the detailed description of the invention and from the appended claims.

BRIEF DESCRIPTION OF THE DRAWINGS

FIG. 4*a* is a side view, showing the housing in cross section and the other components in elevation, of the airlock of the system of FIGS. 1 through 3;

FIG. 4*b* is a side elevational exploded view showing the interior components of the airlock of FIG. 4*a* removed from the housing;

FIG. 4*c* is a side elevational exploded view showing the individual components of each of the valve assemblies of the airlock of FIG. 4*a*;

FIG. 8*a* is a detailed view of the airlock component of the system of FIG. 7;

FIG. 8*b* is a detailed side view of the lower valve assembly only of the airlock of FIG. 8*a*;

FIGS. 8*c* and 8*d* are end views of the airlock valve assembly of FIG. 8*b* showing the valve door associated therewith in closed (FIG. 8*c*) and open (FIG. 8*d*) position;

DETAILED DESCRIPTION OF THE DRAWINGS

Figure 1:
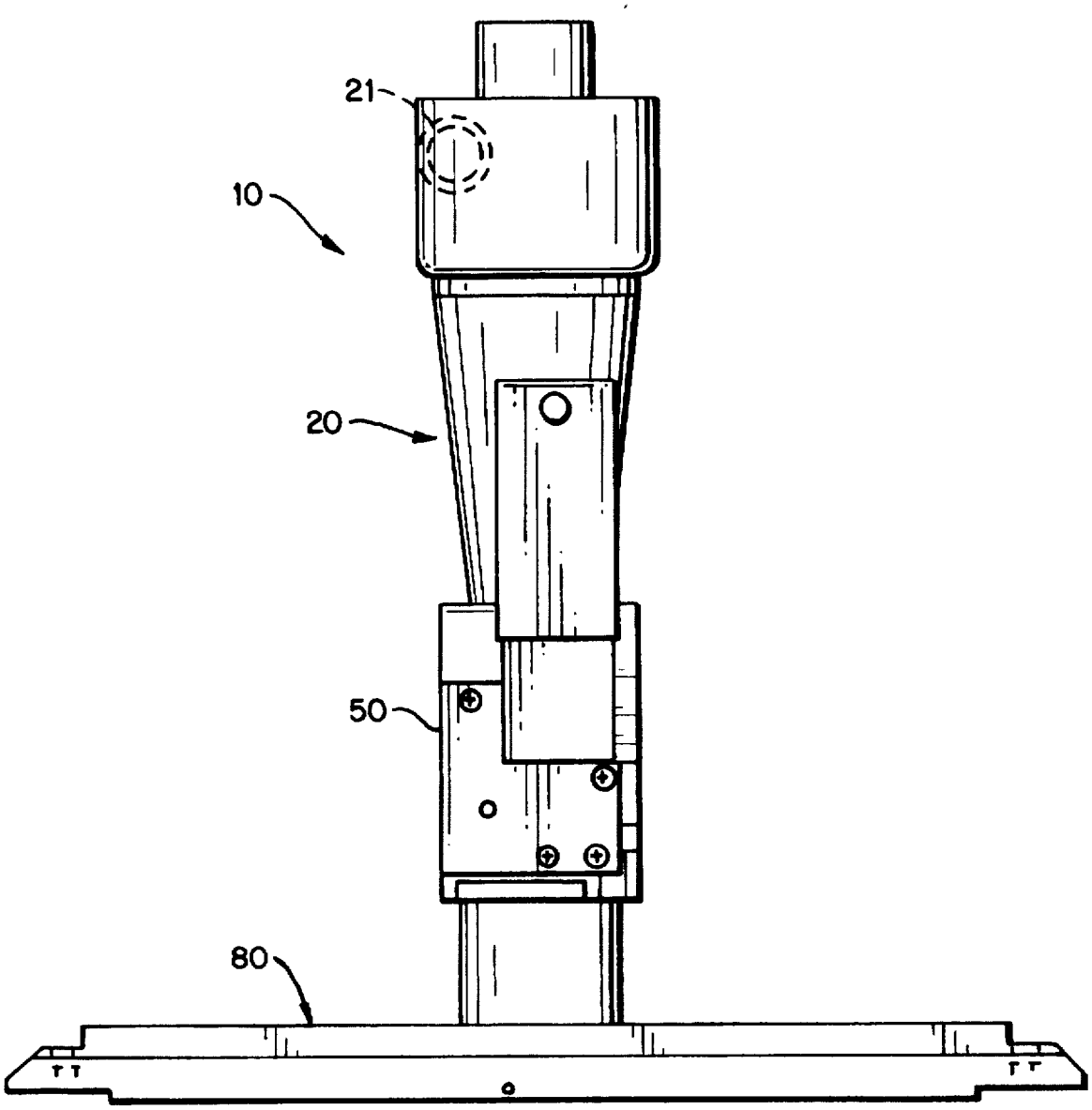
FIG. 1 is a front end elevation view of the major components of a toner recycling system of the invention shown apart from an electrostatic imaging system with which it is utilized.

The invention provides a means for the recycling of waste toner during operation in a single component non-magnetic toner applicator. Referring to FIG. 1, the recycling system 10 comprises three major subcomponents. A cyclonic separation device 20 receives one or more air streams which contain waste toner from an imaging system or systems 11, and separates the toner from the air stream by cyclonic action in a vortex in the main chamber of device 20. The separated toner then drops to the bottom of the device 20 by means of gravity. In many standard conventional configurations, a closed container is statically positioned at the bottom of the cyclonic separator where the powder is collected and can be recycled when the vacuum is terminated during stoppages of the system function. Since a vacuum is constantly drawn from the cyclonic separator, the lower end must remain sealed so the system operates efficiently and the collected powder is not lost to the vacuum being drawn in the cyclonic separator. The invention being described does this dynamically during system operation using at least one multichambered airlock device 50. The airlock 50 provides for an intermediate sealed chamber controlled by multiple valves which removes the toner from the bottom of the cyclone without breaking the vacuum seal. The toner is then delivered through the vertical air lock system 50 by gravity to a toner distributor system 80.

Figure 2:
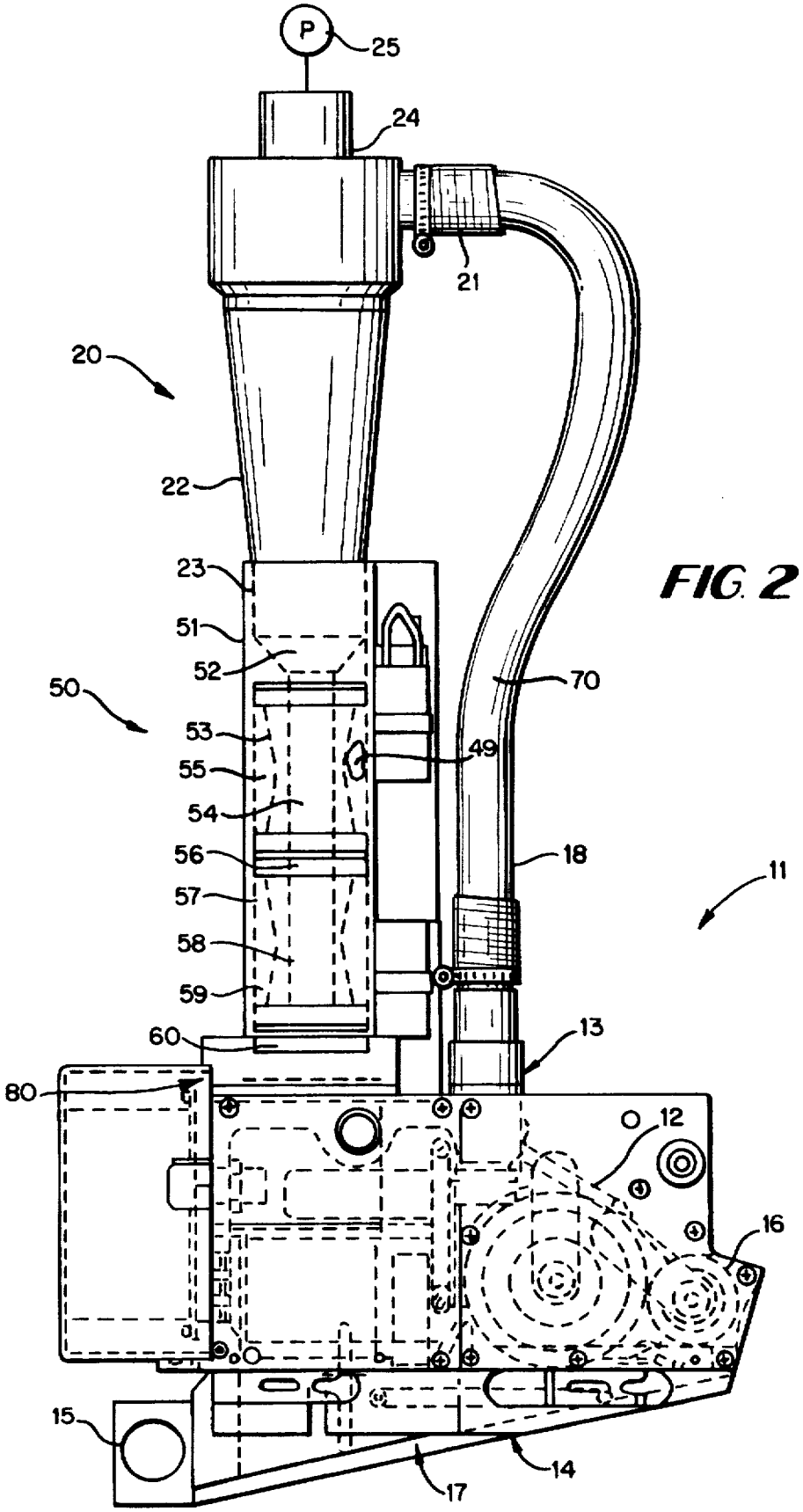
FIG. 2 is a side elevational view, showing interior components in dotted line, of the recycling system of FIG. 1 shown mounted in association with a schematically illustrated exemplary imaging system.
Figure 3:
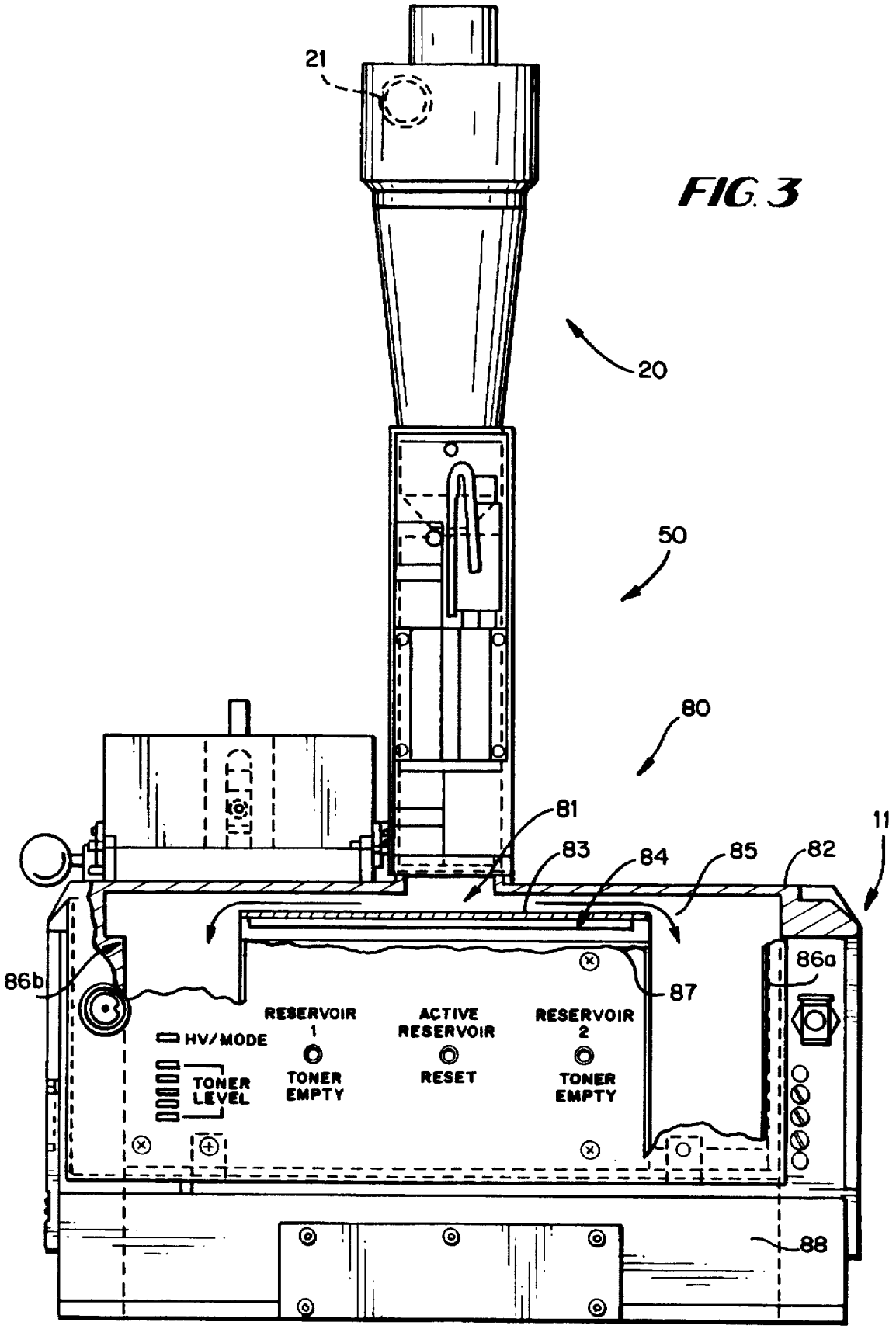
FIG. 3 is a front end view of the system of FIG. 2 primarily in elevation, but showing portions of the imaging system housing cut away to illustrate the distributing means more clearly.

FIG. 2 shows the preferred embodiment of the recycling system positioned on the single component non-magnetic toning system 11. The basic principles of the single component nonmagnetic toning system 11 are described in U.S. Pat. No. 5,532,100. To prevent contamination from stray (wayward) airborne toner within the developer station of system 11, a vacuum source is provided to create appropriate air streams to prevent the toner from escaping from the system 11.

Two vacuum shields, the upper 12 and the lower 14 are provided to prevent the escape of toner which can cause dusting in the electrostatic printing system 11. The upper shield 12 is positioned over the system's toner delivery rollers and provides for a reverse air stream to prevent the toner from escaping over the top of the system applicator roller 16. The reversed air stream is collected to a central point in the attached vacuum manifold 13. From this point, the air stream is drawn up through ventilating tube 18 on up to the tangential inlet 21 to the cyclonic separator 20.

The lower shield 14 creates a counter airstream to collect the stray toner while the electrostatic latent image is developed on the system imaging member (not shown) from the applicator roller 16. The air stream is contained between the shield 14 and the outer housing of the developer station fluidized bed 17. The airstream is collected to a central point in the vacuum manifold 15 where the air stream with the stray toner can also be connected to the cyclonic separator at inlet point 21.

The cyclonic separator 20 is of standard configuration and would be familiar to those who are skilled in the art. The tangential inlet 21 brings in the airstream through a circular opening of between about 0.75 inches and 1.5 inches diameters with an air stream velocity of between about 500 and 2500 feet/minute. This air stream is created by a vacuum pump 25 which is connected to the outlet 24 of the cyclonic separator 20. During its passage through the cyclonic separator 20, the air stream laden with the stray toner particles enters the interior of the cyclone tangentially to its circumference, in tangential inlet 21. It travels in a vortex around the edges as it progressively moves down lower in the conical housing 22 until the stream can no longer descend. It turns upward and moves to the outlet 24 along the central axis of the separator 20. As the air descends, the stray toner is centrifugally forced to the outer walls of the conical section 22 where collisions with the wall cause a loss in toner momentum and separation from the air stream occurs. Finally, the slowed toner drops into the collecting section 23 where it remains until removed through the airlock system 50 below it.

The illustrated valved airlock section or valved system 50 of the toner recycling system preferably has three chambers 52, 56, 60 and two valve stations 55, 58 housed in container 51 with a controller 70 for the valve system 50. Toner collected from the cyclonic separator 20 drops by gravity into the collecting section 23 which also forms the upper chamber of the airlock section 52. Valve structure 55 is formed with a flexible material (e.g. rubber) pinching valve 53 which when subject to pressurized air within chamber 49 closes off at pinching point 54 acting as a sphincter type of valve. The toner rests in the chamber 23 until the valve 55 is opened. When the pressure in chamber 49 is relieved, the rubber valve 53 opens and the toner falls through the central passage past point 54 by gravity down to middle chamber 56 which is formed by the central passage between the upper rubber valve 53 and the lower rubber valve 57 of valve structure 58. While the upper valve structure 55 is opened to allow passage of the collected toner downwardly, the lower valve structure 58 remains closed so as not to allow any leakage in the chambers of valve system 50 so that toner does not escape.

The toner collected in the middle chamber 56 is held back by the closed lower valve structure 58. After a brief interval, the upper valve 53 closes and the toner is in the airlock chamber of valve structure 58 between both closed valves 53, 57. When the upper valve is closed, the lower rubber valve 57 is opened by releasing the pressurized air in the chamber 59. When valve 57 opens, the collected toner falls by gravity force through the open passage in the interior of valve structure 58 and falls into the lower chamber 60 where it will eventually fall into the toner distributor section 80. The controller 70 for the valve system 50 will be described later with respect to the control schematic of FIG. 5.

The toner distributor section 80 provides a means for return of the toner back to the reservoir 88 in the fluidized bed 107. The collected toner having been separated from the air stream by cyclonic separator 20 and delivered downward through the multiple chamber airlock 50, passes into the central chamber 81 of the toner distributor 80. Enclosed in housing 82, the toner falls onto porous plate 83. The porous plate 83 preferably is a sintered stainless steel plate with average pore size of about 0.2 μM. Air under pressure is forced through the plate coming from the lower air plenum 83 which is formed by the porous plate 83 and the housing 87. The effect of the air is to form a layer of rising air at the surface of the plate 83 which suspends the collected toner and allows it to flow horizontally out away from the central chamber 81, to the sides 85 of the developer station where the toner delivery tubes **86*a*, 86*b* allow the toner to fall by gravity to return to the reservoir 88 in the fluidized bed. The effect of the porous plate 83 and air layer rising from it is to create a means for the transport of the toner in a horizontal or angled channel very much like an open channel or chute used to direct liquids. In this state with the toner levitated by the rising column of air, the toner behaves like an in-viscid fluid and flows rapidly out to the toner delivery tubes 86*a*, 86*b*, and ultimately to reservoir 88**.

FIGS. **4*a*–4*c* show various views of the airlock section 50. FIG. 4*a* is a side view showing the housing 51 in cross section and the other, interior, components in elevation. FIG. 4*b* is an exploded view of the components inside the housing 51 of FIG. 41, and FIG. 4*c* is an exploded view of the components of one of the valve members 62 (in this case the upper valve assembly containing rubber valve 53, although the lower assembly—with rubber valve 57**—is substantially identical).

Inside the housing 51, the components are stacked vertically and are held within the housing 51 by a single retaining ring 66 which fits into the radial slot 68 at the bottom of the housing 51. The upper and lower valve assemblies 62 consist of the rubber pinching valves 53, 57 which are inserted into the housing 51 so a pressurizing chamber 49 is formed around the rubber pinching valve 53, and a chamber 59 around valve 57 (see FIG. 5). An air passage for the pressurizing air is through orifice 67. The valve assemblies 62 are inserted into the housing 51 along with the upper positioning flange 63, the lower positioning flange 65, and the middle flange 64.

Figure 5:
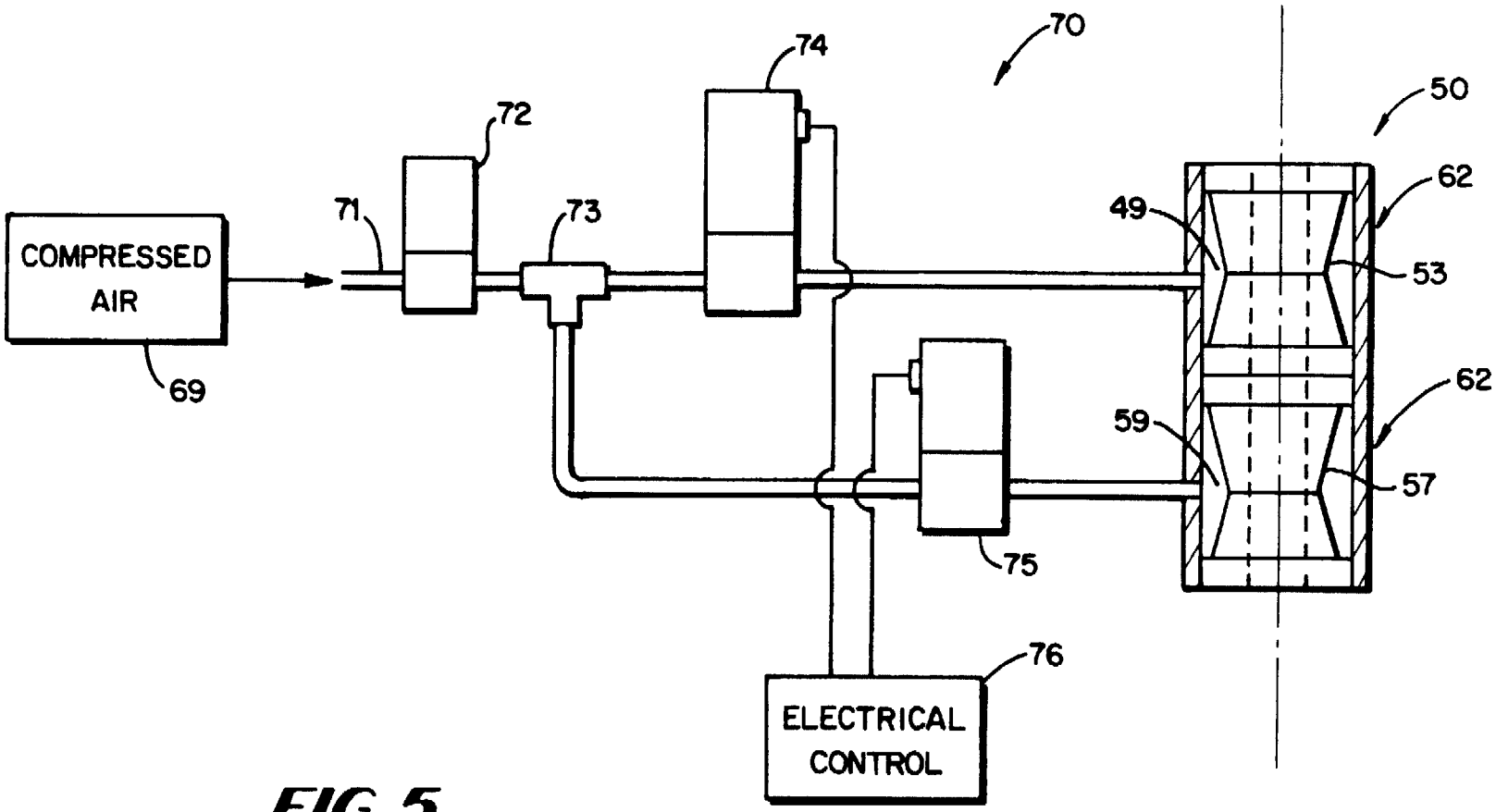
FIG. 5 is a schematic view of the airlock of FIG. 4*a* shown in association with an exemplary automatic control means for operating the airlock of FIG. 4*a*

FIG. 5 is a schematic representation of the controlling system 70 for the airlock 50. A source of pressurized gas 69 supplies air or other activating fluid which enters the controlling system 70 at inlet 71. The air is regulated to a preferred pressure between about 20 and 35 p.s.i. by air pressure regulator 72. The air then goes to a distributor represented schematically by the tee 73 where the air is distributed to the system solenoid valves 74, 75. The solenoid valves 74, 75 deliver air to the rubber pinch valves 53, 57 of the assemblies 62 in the airlock section 50. Valves 74, 75 are controlled by the electrical controller 76. The controller 76 successively activates the solenoid valves 74, 75 to control both rubber pinch valves 53, 57 to control time of passage through the airlock 50. The cycle time for opening and closing both valves 74, 75 in the system preferably is between 2–20 seconds, e.g. between about 5–15 seconds.

Figure 6:
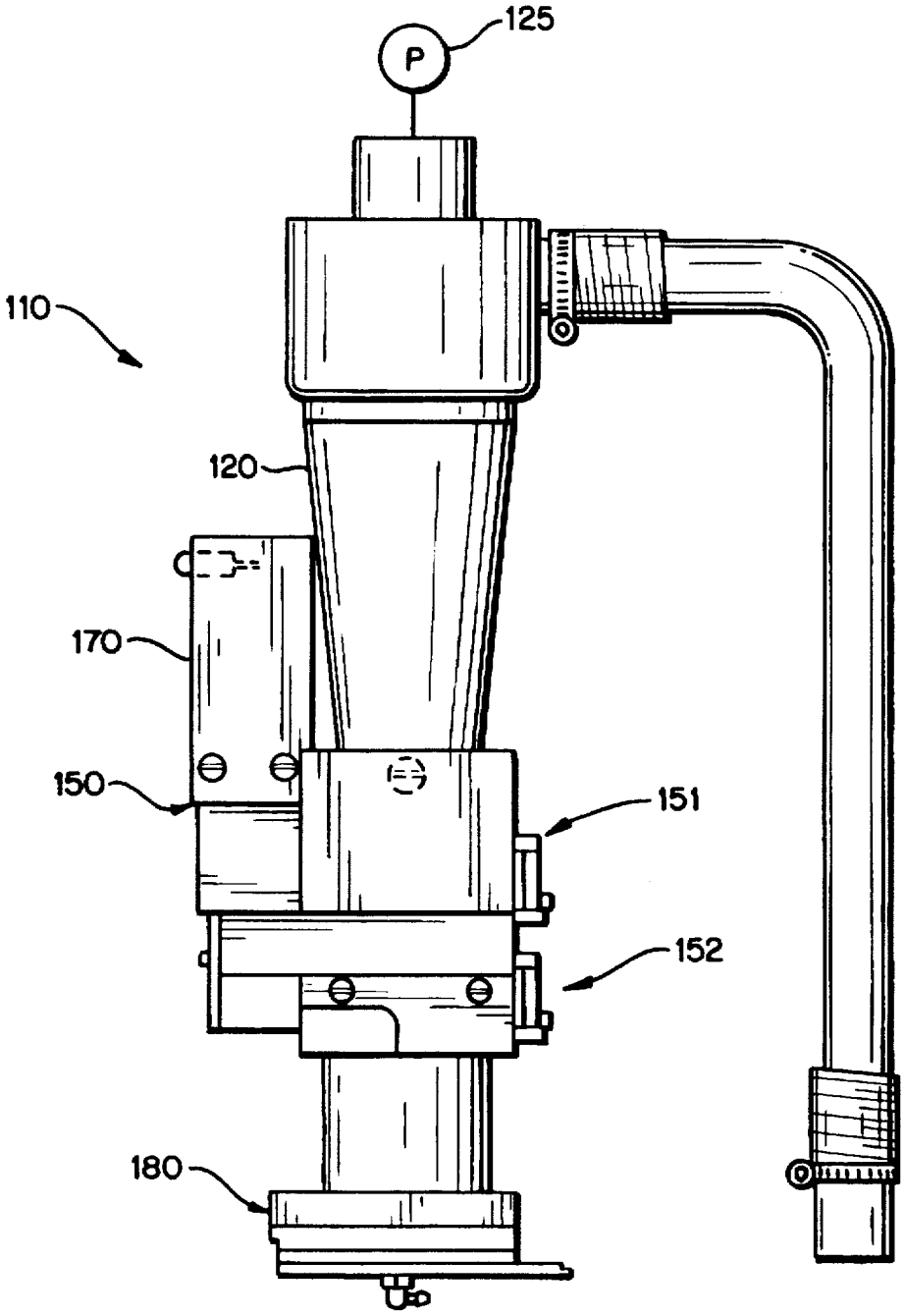
FIG. 6 is a side view of a second embodiment of a toner recycling system according to the present invention, shown apart from the imaging system with which it is typically used.

In another embodiment of the basic airlock system, mechanically controlled doors may be utilized instead of pinch valves. FIG. 6 is a side schematic view of a "doors" embodiment. The timer recycling system 110 consists of the same major subcomponents as the FIGS. 1–5 embodiment. The cyclonic separator assembly 120 separates the entrapped air from the air stream developed by the system vacuum pump 125. The collected toner drops by gravity into the airlock 150 which has the same three chambers as described in the FIGS. 1–5 embodiment, and two identical mechanical door mechanisms 151, 152 control the airlock 150. The system controller 170 comprises a motor 171 with a conventional small gear train and cam mechanisms (not shown in FIG. 6) which activate the airlock doors 151, 152. After passing through the airlock 150, the collected toner is returned to the fluidized toner reservoir after passing through the toner distributor section 180 (like section 80).

Figure 7:
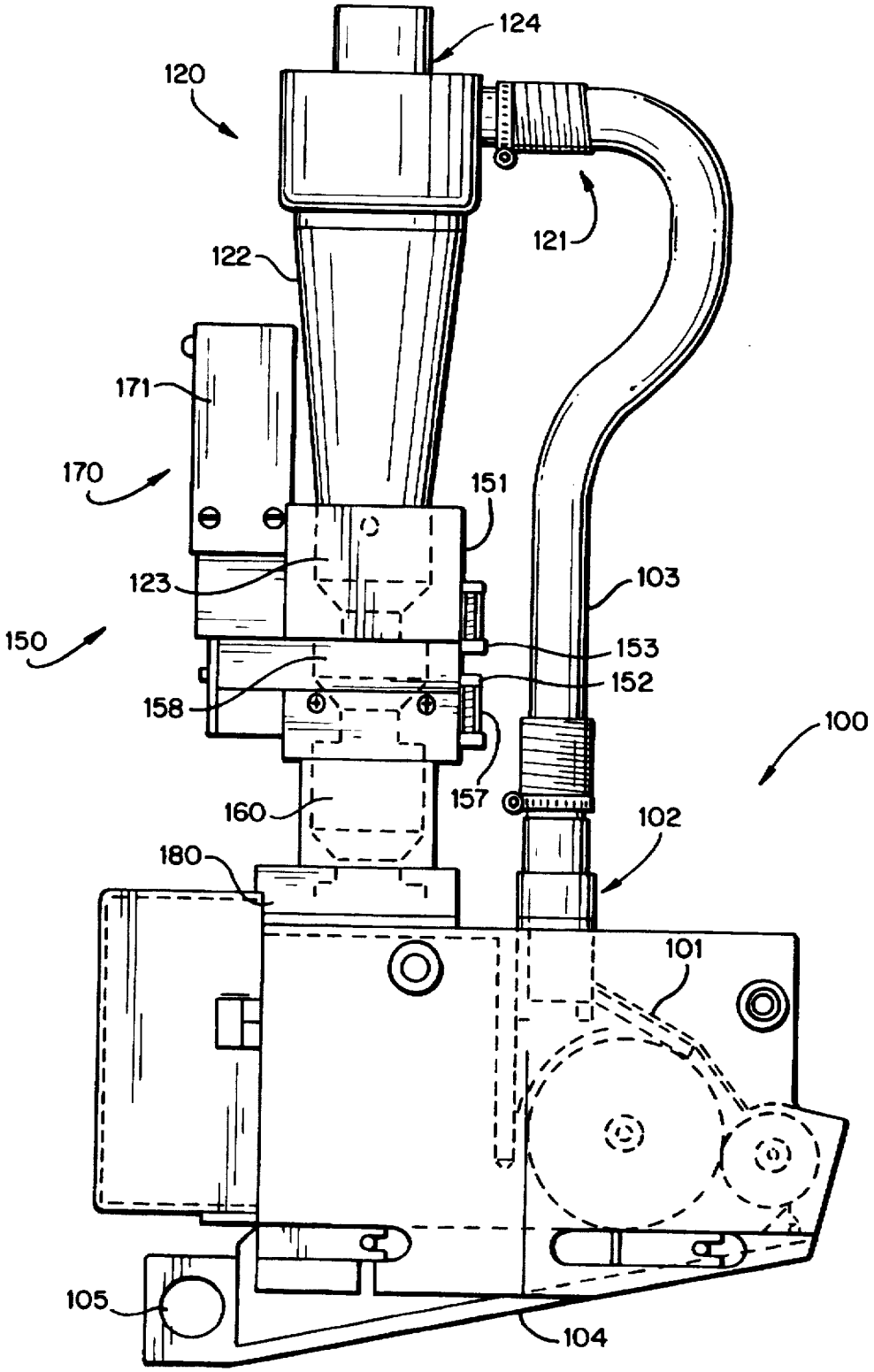
FIG. 7 is a view like that of FIG. 6 only showing the recycling system in combination with a schematically illustrated imaging system.

FIG. 7 illustrates the details of the mechanical door airlock 150 and how it relates to developer station. The developer station 100 is substantially identical to that in the FIG. 2 embodiment, having an identical upper shield/manifold assembly 101, 102 and lower shield/manifold assembly 104, 105. The toner is delivered to the cyclonic separator assembly 120 through the tube 103. The components and functions of the components in the cyclonic separator 120 are exactly the same as those described above with respect to separator 20. After the toner is separated from the airstream by the cyclonic separator 120, it falls by gravity into the airlock assembly 150 first into the upper toner chamber 123 located in the upper valve assembly 151. This valve assembly 151 consists of the toner chamber 125 and a pivoting mechanism 153 on which the airlock sealing door rides. The collected toner is held here until the door opens, allowing toner to fall into the middle chamber 158, located in the lower valve assembly 152. As with the sequence in the FIGS. 1–5 embodiment, the valves are timed so that there is always one of the valves in the closed position to prevent escape of toner through the cyclone 120. The collected toner in middle chamber 158 is temporarily held there until the upper valve assembly 151 is shut and the lower valve assembly 157 opens. Then the collected toner falls by the force of gravity to the lower chamber 160 and eventually ends up in the toner distributor assembly 180, to pass to the fluidized toner bed reservoir.

Details of the airlock assembly 150 and the controller assembly 170 can be seen in FIGS. 8*a* and 8*b*. The door opening sequence is controlled by a conventional cam driven mechanism turned, e.g., by electric motor 171. The motor 171 drives a worm gear 172 and spur gear 173 to which an actuating pin is attached. As the spur gear 172 is turned, the actuating pin successively lifts the upper driving cam 174 and the lower driving cam 175 sequencing the toner valve doors open and shut. The upper driving cam 174 is attached to axle 176. On the opposing side of the housing 151 from cam 174, a lever 155 with extension spring 154 is attached to the axle 176. The action of the spring 154 whose opposite end is mounted to the housing 151 is to keep the valve door 156 closed when not engaged to be opened by the driving cam 174.

The operation of the lower valve assembly 152 is substantially identical to that of the upper valve assembly 151. FIGS. 8*a*–8*c* show the operation of the door 157 of the lower valve assembly 152. FIG. 8*b* is a front view of the assembly 152 showing the door 157 closed. FIG. 8*c* is a side view of the assembly 152 with the door 157 closed, and FIG. 8*d* is a view identical to that of FIG. 8*c* only with the door 157 open, having been moved to the position illustrated by the cam 175 against the bias of the spring 154. The operation of door 156 is substantially identical to that of door 157.

Figure 9A:
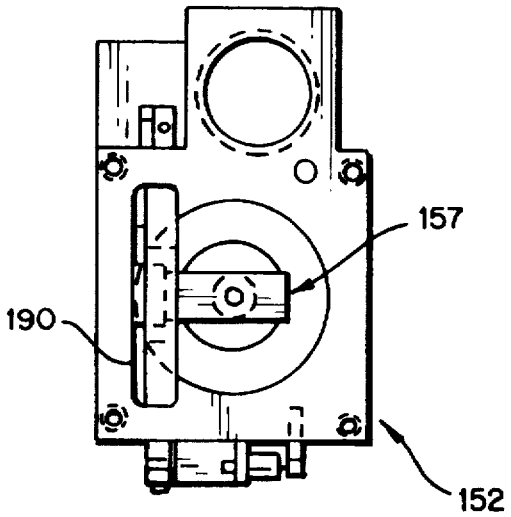
FIG. 9*a* is a bottom plan view of the valve assembly of FIGS. 8*b* through 8*d*.
Figure 9B:
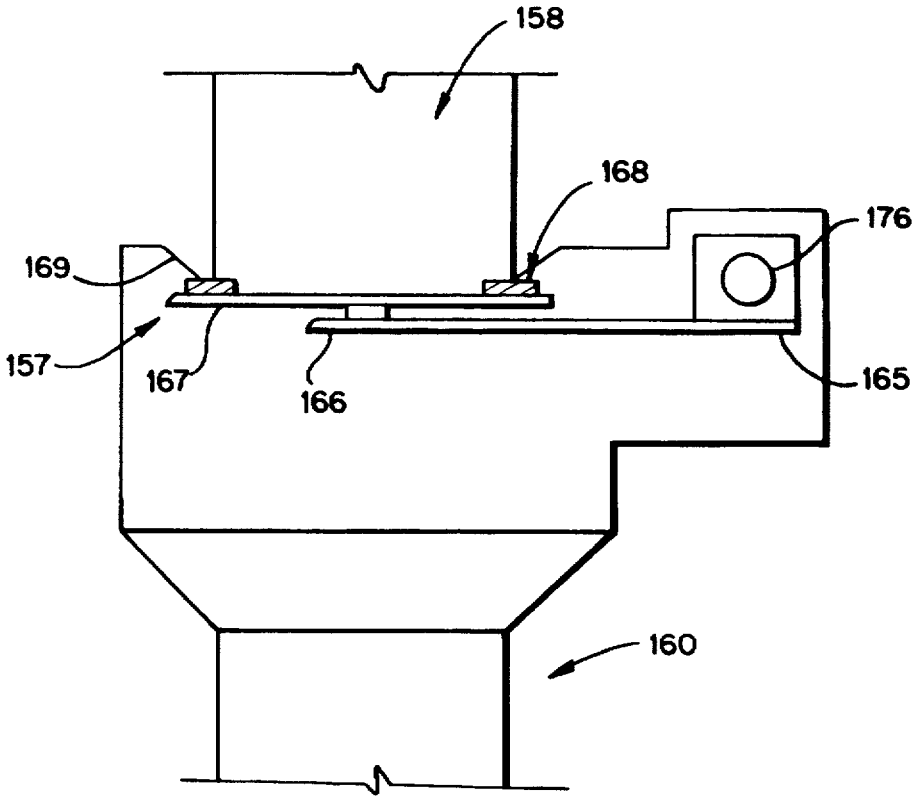
FIG. 9*b* is a schematic view illustrating in detail the operation of the valve closure of the valve assembly of FIGS. 8*b*–8*d* and 9*a*.

FIG. 9*a* is a bottom view of the valve assembly 152, showing door 157 and a torsional seal 190 which prevents contamination of the bearing surfaces of the axle 176 by the collected toner. FIG. 9*b* schematically illustrates in detail the preferred specifics associated with the door 157 to insure proper operation and sealing thereof when moved between the positions of FIGS. 8*c* and 8*d*.

The axle 176 is driven by the motor 171 and 174 cam assembly described above. With the cam drive, the axle 176 rotates about 30 degrees allowing the lever arm 165 carrying the actual valve closure 167 to open and shut the opening from the channel 158 above. The actual valve closure 167 is attached to the lever arm 165 at a central pivotal point 166. This allows for even seating of the actual closure 167 of the valve door 157 on the seat 169 as closure 167 locates with even pressure. The closure 167 is sealed against the raised bevel seat 169 with an annular ring 168 of an adhesive backed foam material or other resilient seal-facilitating material. The standard material for ring 168 used in this application is "Poron"

Figure 9C:
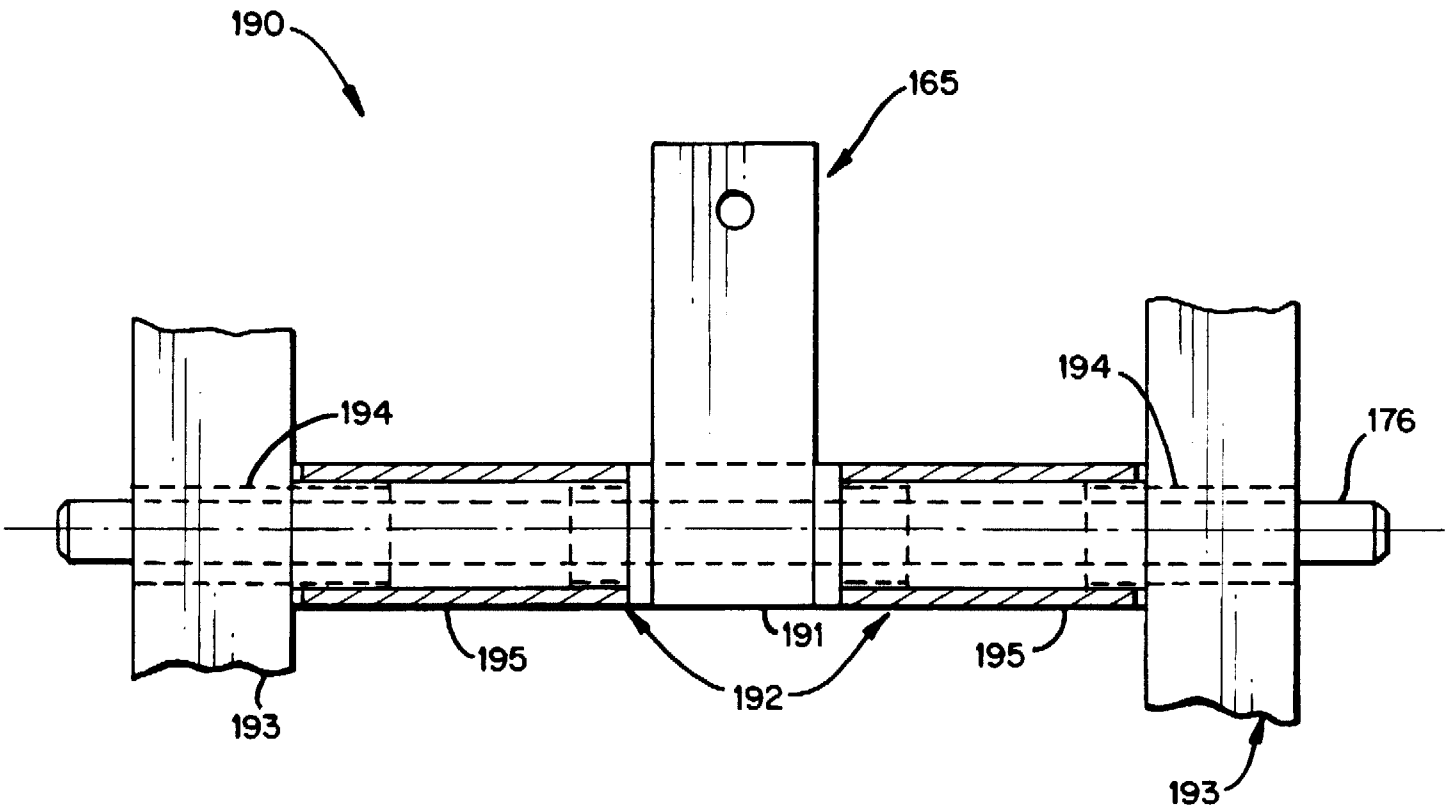
FIG. 9*c* is a detail end view, partly in cross section and partly in elevation, of the shaft sealing components associated with the valve assembly of FIGS. 8*b*–8*d*, 9*a* and 9*b*.

The torsional seal assembly 190 is illustrated in FIG. 9*c*. The axle 176 is rotated through an included swept angle of about 30 degrees. Since the assembly is in the dusty environment of toner, a substantially perfect sealing mechanism is highly desirable to prevent contamination of the moving components. This is effected with the torsional seal mechanism 190. Lever arm 165 is connected to the axle 176 through a pivoting block 191. The block 191 is locked to the axle 176 and includes two circular opposing shoulders 192. The axle 176 rotates within bushings 194 which are mounted into the side framework of the airlock housing 193. The bushings 194 are installed so that a shoulder stands proud of the side framework on the inside of the housing 193. The bushings 194 have the same outside diameter as the opposing shoulders 192 on the central pivoting block 191. Thin silicone tubing pieces 195 are pressed over the shoulders 192 of the central pivoting block 191 and outer bushings 194 and form a tight seal at each location. The limited travel (about 30 degrees) of the axle 176, allows the silicone tube 195 to twist torsionally and never lose a perfect seal with the bushings 194 or the central pivoting block 191.

While the invention has been described with respect to "air" streams containing toner, it is to be understood that the term "air" is used herein very generically, and encompasses not only chemically ambient air, but also other types of gases, such as substantially pure gases of other types including inert gases (e. g. nitrogen), or mixtures of gases.

It will thus be seen that an effective, simple, and relatively inexpensive solution has been provided to the problem of dusting from wayward toner particles. While the invention is applicable to any electrostatic imaging system, it is particularly applicable to a non-magnetic toner electronic imaging system such as the Moore MIDAX® system. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of reusing toner in an electrostatic imaging system, the electrostatic imaging system using a fluidized bed of toner particles supplied by a reservoir of non-magnetic toner particles; said method comprising the steps of:

(a) vacuum collecting airborne wayward toner particles in the electrostatic imaging system to provide an air stream with entrained toner particles;

(b) causing the air stream with entrained toner particles to flow in a vortex so that the toner particles are separated from the entraining air; and (c) dynamically returning the separated toner particles to the electrostatic imaging system, by returning the non-magnetic toner particles to the reservoir through at least one airlock which comprises first and second flexible material pinching valves, by selectively applying fluid under pressure to the first and second valves so that only one valve is open at a time.

2. A method as recited in claim 1 wherein step (b) is practiced vertically above the airlock, and wherein the airlock is vertically above the reservoir, so that after separation from entrained air the toner particles flow primarily by gravity to the reservoir.

3. A toner recycling system comprising:

an imaging system which applies toner to substrates, said imaging system including a fluidized bed of non-magnetic toner particles supplied with particles by a reservoir;

a centrifugal separator for separating toner particles from air entraining the toner particles;

a vacuum system for collecting wayward airborne toner particles from said imaging system, and delivering the toner particles entrained in air to said centrifugal separator;

means for dynamically returning toner particles, separated from said entrained air by said centrifugal separator, to said imaging system, said means for dynamically returning toner particles comprising at least one airlock between said imaging system and said separator; and a fluidizing distributing means between said airlock and said reservoir to cause particles to flow from said airlock to said reservoir.

4. A toner recycling system as recited in claim 3 wherein said vacuum system includes a hose extending upwardly from said imaging system to said separator inlet, and a vacuum pump connected to said separator outlet.

5. A toner recycling system as recited in claim 3 wherein said at least one airlock comprises first and second flexible material pinching valves; and means for selectively applying fluid under pressure to said first and second valves so that only one valve is open at a time.

6. A toner recycling system as recited in claim 3 wherein said at least one airlock comprises first and second mechanically actuated valves; and means for selectively mechanically actuating said first and second valves so that only one valve is open at a time.

7. A toner recycling system comprising:

a vertically oriented centrifugal separator having a top and a bottom, an inlet, a toner outlet adjacent said bottom, and a fluid outlet adjacent said top;

an airlock assembly vertically below said toner outlet and connected thereto in substantially air-tight relationship, said airlock assembly including a vertical tubular housing having at least two pinching valve assemblies stacked one above the other in said housing, each pinching valve assembly comprising a flexible valve element, an open volume surrounding said flexible valve element, and an automatically controlled fluid supply means for supplying fluid to said open volumes of each of said pinching valve assemblies so that only one valve is open at a time; and a toner distributing means located beneath said airlock assembly for distributing toner from said airlock assembly into at least two different paths.

8. A toner recycling system as recited in claim 7 wherein said centrifugal separator inlet opening is substantially circular, having a diameter of between about 0.75–1.5 inches, and is connected to a vacuum hose; and wherein said fluid outlet is connected to a vacuum pump.

9. A method of reusing toner in an electrostatic imaging system, comprising the steps of:

(a) vacuum collecting airborne wayward toner particles in the electrostatic imaging system to provide an air stream with entrained toner particles;

(b) causing the air stream with entrained toner particles to flow in a vortex so that the toner particles are separated from the entraining air, by using a centrifugal separator having a substantially circular inlet opening having a diameter of between about 0.75–1.5 inches; and by introducing toner particles entrained in air into the opening at a velocity of between about 500–2500 feet per minute; and (c) dynamically returning the separated toner particles to the electrostatic imaging system.

10. A toner recycling system comprising:

an imaging system which applies toner to substrates;

a centrifugal separator for separating toner particles from air entraining the toner particles;

a vacuum system for collecting wayward airborne toner particles from said imaging system, and delivering the toner particles entrained in air to said centrifugal separator;

at least one airlock between said imaging system and said separator; and wherein said centrifugal separator is vertically oriented, having a top and a bottom, and includes a tangential inlet opening, a gas outlet from adjacent said top thereof, and a particle outlet from adjacent said bottom thereof; and wherein said airlock is located vertically below said particle outlet, and wherein said imaging system is located vertically below said airlock, so that recycled toner may flow primarily by gravity from said separator to said imaging system.

11. A toner recycling system as recited in claim 10 wherein said vacuum system includes a hose extending upwardly from said imaging system to said separator inlet, and a vacuum pump connected to said separator outlet.

12. A toner recycling system comprising:

a vertically oriented centrifugal separator having a top and a bottom, an inlet, a toner outlet adjacent said bottom, and a fluid outlet adjacent said top;

an airlock assembly vertically below said toner outlet and connected thereto in substantially air-tight relationship, said airlock assembly including at least first and second valves;

a toner distributing means located beneath said airlock assembly for distributing toner from said airlock assembly into at least two different paths; and wherein said centrifugal separator inlet opening is substantially circular, having a diameter of between about 0.75–1.5 inches, and is connected to a vacuum hose; and wherein said fluid outlet is connected to a vacuum pump.

13. A toner recycling system as recited in claim 12 wherein said airlock assembly comprises first and second mechanically actuated valves, and means for selectively mechanically actuating said first and second valves so that only one valve is open at a time.

14. A method of reusing toner in an electrostatic imaging system, the electrostatic imaging system using a fluidized bed of toner particles supplied by a reservoir of non-magnetic toner particles; said method comprising the steps of:

(a) vacuum collecting airborne wayward toner particles in the electrostatic imaging system to provide an air stream with entrained toner particles;

(b) causing the air stream with entrained toner particles to flow in a vortex so that the toner particles are separated from the entraining air; and (c) dynamically returning the separated toner particles to the electrostatic imaging system, by returning the non-magnetic toner particles to the reservoir through at least one airlock, and by distributing the toner in at least two different substantially horizontal paths after the toner passes through the at least one airlock, and before it returns to the reservoir.

15. A method as recited in claim 14 wherein the electrostatic imaging system uses a fluidized bed of toner particles supplied by a reservoir of non-magnetic toner particles; and wherein step (c) is practiced by returning the non-magnetic toner particles to the reservoir.

16. A method as recited in claim 15 wherein step (b) is practiced vertically above the airlock, and wherein the airlock is vertically above the reservoir, so that after separation from entrained air the toner particles flow primarily by gravity to the reservoir.

17. A method as recited in claim 14 wherein step (c) is further practiced by entraining the toner particles in air to facilitate substantially horizontal flow thereof.

18. A method of reusing toner in an electrostatic imaging system, the electrostatic imaging system using a fluidized bed of toner particles supplied by a reservoir of non-magnetic toner particles; said method comprising the steps of:

(a) vacuum collecting airborne wayward toner particles in the electrostatic imaging system to provide an air stream with entrained toner particles;

(b) causing the air stream with entrained toner particles to flow in a vortex so that the toner particles are separated from the entraining air; and (c) dynamically returning the separated toner particles to the electrostatic imaging system, by returning the non-magnetic toner particles to the reservoir through at least one airlock; and wherein step (b) is practiced vertically above the airlock, and wherein the airlock is vertically above the reservoir, so that after separation from entrained air the toner particles flow primarily by gravity to the reservoir.

19. A method as recited in claim 18 wherein step (b) is practiced by using a centrifugal separator having a substantially circular inlet opening having a diameter of between about 0.75–1.5 inches; and by introducing toner particles entrained in air into the opening at a velocity of between about 500–2500 feet per minute.

* * * * *